US009254511B2

(12) United States Patent
Saitou et al.

(10) Patent No.: US 9,254,511 B2
(45) Date of Patent: Feb. 9, 2016

(54) METHOD FOR PRODUCING SEAMLESS TUBE/PIPE

(75) Inventors: Kenichi Saitou, Tokyo (JP); Kazuhiro Shimoda, Tokyo (JP); Tomio Yamakawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 319 days.

(21) Appl. No.: 13/991,635

(22) PCT Filed: Dec. 6, 2011

(86) PCT No.: PCT/JP2011/006813

§ 371 (c)(1), (2), (4) Date: Jun. 5, 2013

(87) PCT Pub. No.: WO2012/077334

PCT Pub. Date: Jun. 14, 2012

(65) Prior Publication Data

US 2013/0255342 A1 Oct. 3, 2013

(30) Foreign Application Priority Data

Dec. 8, 2010 (JP) ..... 2010-273205

(51) Int. Cl.

| | |
|---|---|
| ***B21B 21/02*** | (2006.01) |
| ***B21B 19/04*** | (2006.01) |
| *B21B 25/00* | (2006.01) |

(52) U.S. Cl.

CPC ..... *B21B 21/02* (2013.01); *B21B 19/04* (2013.01); *B21B 25/00* (2013.01); *B21B 2261/08* (2013.01); *B21B 2261/10* (2013.01)

(58) Field of Classification Search

CPC ..... B21B 17/02; B21B 17/04; B21B 19/02; B21B 19/04; B21B 21/02; B21B 2261/08; B21B 2261/10

See application file for complete search history.

(56) References Cited

U.S. PATENT DOCUMENTS

2009/0064748 A1 * 3/2009 Yamakawa et al. ..... 72/97

FOREIGN PATENT DOCUMENTS

| | | |
|---|---|---|
| JP | 2001-058207 | 3/2001 |
| JP | 2001-162307 | 6/2001 |
| JP | 2002-224711 | 8/2002 |
| JP | 2002-361384 | 12/2002 |
| JP | 2006-110590 | 4/2006 |
| JP | 2008-126255 | 6/2008 |
| WO | 2007/116821 | 10/2007 |
| WO | 2008/062752 | 5/2008 |

* cited by examiner

*Primary Examiner* — Debra Sullivan
(74) *Attorney, Agent, or Firm* — Clark & Brody

(57) ABSTRACT

By using a piercing mill that includes a pusher on the entrance side, a plug on the exit side along a pass line, and a plurality of angled rolls as being provided around the plug so as face to each other, in the case where the maximum diameter of an unsound region consisting of center segregation and porosity in a cross section of a billet is d [mm], piercing-rolling is performed under the condition that the plug nose rolling reduction ratio (TDF) expressed by Formula (1) satisfies Formula (2).

$$TDF=(Bd-D1)/Bd \quad (1)$$

$$TDF\leq-0.50\times(d/Bd)+0.06 \quad (2)$$

In Formulae (1) and (2), Bd is the billet diameter [mm], and D1 is the opening [mm] between the angled rolls at the plug nose position. Thereby, when piercing-rolling is performed, the occurrence of an inner surface flaw attributable to the center segregation and porosity in the billet can be prevented reliably.

8 Claims, 3 Drawing Sheets

(a)

(b)

METHOD FOR PRODUCING SEAMLESS TUBE/PIPE

TECHNICAL FIELD

The present invention relates to a method for producing a seamless tube/pipe using the Mannesmann tube-making process. More particularly, it relates to a method for producing a seamless tube/pipe, in which when a billet is subjected to a piercing-rolling process by using a piercing mill, a flaw to be generated on the inner surface of tube/pipe on account of center segregation and porosity in the billet is prevented from occurring.

BACKGROUND ART

A seamless tube/pipe can be produced by the Mannesmann tube-making process. This tube-making process consists of the following steps:

(1) A round billet heated to a predetermined temperature is subjected to a piercing-rolling process by using a piercing mill (piercer) to form a hollow blank (hollow shell).

(2) The hollow blank is subjected to an elongation-rolling process by using an elongation-rolling mill (for example, a mandrel mill).

(3) The hollow shell thus elongated is sized so as to have a predetermined outside diameter and wall thickness by using a sizing mill (for example, a stretch reducer).

The piercing mill used in the piercing-rolling step among these steps includes a plurality of angled rolls, a plug, and a pusher as principal components. The pusher is provided on the entrance side along the pass line. The plug is disposed on the exit side along the pass line. The angled rolls are provided around the plug so as to face to each other in a state of having a predetermined crossing angle with respect to the pass line and inclination angle to the horizontal.

In the piercing-rolling using the piercing mill, a billet heated in a heating furnace is supplied along the pass line, and the rear end thereof is pushed by the pusher. Thereby, the billet is conveyed along the pass line toward the angled rolls and the plug, and the front end thereof is engaged into the angled rolls. Thereafter, the billet engaged into the angled rolls advances along the pass line while being rotated by action of the angled rolls. At this time, by the rotary forging effect, Mannesmann fracture is generated successively in the central portion of the billet until the billet reaches the plug nose, and thereby the core part of billet becomes torn off in a brittle manner. Successively, the billet is subjected to a wall-thickness rolling work process by the plug contacting with the central portion thereof and the angled rolls contacting with the outer circumference thereof, and thereby the hollow blank is formed.

The piercing-rolling is performed on an as-continuously-cast billet, which is cast to have a circular cross section, or a billet which is rolled to have a circular cross section by subjecting a cast slab to hot working such as blooming. In the core portion of such a billet, center segregation and porosity more or less occur, and especially for an alloy such as a stainless steel, they occur remarkably. Therefore, on account of the center segregation and porosity in the billet, a leaf-like, fin-like, or lap-like flaw (hereinafter, referred to as an "inner surface flaw") is generated on the inner surface of the pierced hollow blank by the rotary forging effect at the time of piercing-rolling and by the additional shearing deformation caused by the wall-thickness rolling work.

The prior art for preventing the occurrence of inner surface flaw at the time of piercing-rolling is disclosed in the Patent Literatures described below.

Patent Literature 1 discloses a method for producing a seamless tube/pipe, in which the rotational speed of the angled rolls is restricted to less than 4.5 m per second in circumferential speed, and a back pressure is applied to the billet by the pusher until the billet is securely engaged into the angled rolls. Further, in the technique disclosed in this Literature, piercing-rolling is performed under the condition that a plug nose draft "d/D" is 97% or more, the plug nose draft being defined as the ratio of the angled rolls opening "d" at the plug nose position to the billet diameter "D".

Patent Literature 2 discloses a pusher which applies a back pressure to the billet until the billet is securely engaged into the angled rolls, and the pushing speed and back pressure of which are variable. Also, this Literature describes that it is necessary to increase the back pressure generated by the pusher with the increase in a draft in terms of the ratio of "roll opening at plug nose position to billet diameter", which is defined in the same way as a plug nose draft described in Patent Literature 1, and gives 98%, 98.5%, 98.9%, and 99.1% as the draft.

Patent Literature 3 discloses a method for producing a seamless tube/pipe, in which during the time period between when the billet is engaged into the angled rolls and comes into contact with the plug and when the piercing-rolling becomes in a steady state, the billet is pushed by the pusher so that the traveling speed of billet is not less than the traveling speed in a steady state. Further, in the technique disclosed in this Literature, piercing-rolling is performed under the condition that the ratio "Dg/d" of the gorge portion diameter "Dg" of the angled roll to the billet diameter "d" is not less than 4.5, and the gorge draft ratio "Rg/d", which is defined by the ratio of the gorge portion roll opening "Rg" to the billet diameter "d", satisfies the specified range in accordance with the piercing-rolling ratio "L1/L0", which is defined by the ratio of the pierced hollow blank length "L1" to the billet length "L0".

Patent Literature 4 discloses a method for producing a seamless tube/pipe, in which piercing-rolling is performed under the conditions that the plug nose rolling reduction ratio (TDF) defined by Formula (a) is not more than 0.04, and/or the square root "$(TDF \times N)^{0.5}$" of the product of the plug nose rolling reduction ratio (TDF) and the billet rotational speed "N" is not more than 0.4, and the gorge rolling reduction ratio, which is defined in the same way as the gorge draft ratio described in Patent Literature 3, satisfies the specified range in accordance with the piercing-rolling ratio that is the same as that of Patent Literature 3:

$$TDF = 1 - (d1/\mathrm{Bd}) \quad \text{(a)}$$

where, in Formula (a),

Bd: billet diameter [mm], and d1: angled roll opening [mm] at plug nose position.

Further, in the technique disclosed in this Literature, piercing-rolling is performed by using a plug having such a geometry that the ratio "L2/d2", given that "L2" is the length of the rolling portion of the plug, and "d2" is the outside diameter of the reeling start point of the plug, satisfies the specified range in accordance with the square root "$(TDF \times N)^{0.5}$" of the product of the plug nose rolling reduction ratio (TDF) and the billet rotational speed "N". At this time, the billet is pushed by the pusher at least until the piercing-rolling reaches a steady state from an unsteady state.

CITATION LIST

Patent Literature

Patent Literature 1: Japanese Patent Application Publication No. 2001-162307

Patent Literature 2: Japanese Patent Application Publication No. 2001-58207

Patent Literature 3: International Publication No. WO2007/116821

Patent Literature 4: International Publication No. WO2008/062752

SUMMARY OF INVENTION

Technical Problem

In the prior art disclosed in Patent Literatures 1 to 4, paying attention to the plug nose rolling reduction ratio (TDF: "1—(roll opening at plug nose position/billet diameter)"), an attempt is made to prevent the occurrence of inner surface flaw by decreasing the plug nose rolling reduction ratio when piercing-rolling is performed. The reason for this is that if the plug nose rolling reduction ratio is decreased, the inner surface flaw becomes less liable to occur because the rotary forging effect is suppressed. In the techniques disclosed in Patent Literatures 1 to 4, in the case where the plug nose rolling reduction ratio is decreased, since the engagement of the billet into the angled rolls becomes unsteady, to prevent this poor roll engagement, the pushing of the billet by means of the pusher is continued until the piercing-rolling reaches the steady state.

However, as described later, as the result of tests conducted under various conditions by the present inventors, it was found that even if the plug nose rolling reduction ratio is merely decreased as in the prior art, the extent of occurrence of the center segregation and porosity in the billet exerts a great influence, and in some cases, an inner surface flaw occurs. That is, if the plug nose rolling reduction ratio is merely decreased, the occurrence of inner surface flaw cannot be prevented reliably.

The present invention has been made to solve the above problem, and accordingly an objective thereof is to provide a method for producing a seamless tube/pipe, the method being characterized in that when piercing-rolling is performed, the occurrence of an inner surface flaw caused by center segregation and porosity in a billet is prevented reliably.

Solution to Problem

The summaries of the present invention are as follows:

A method for producing a seamless tube/pipe, in which a billet is subjected to a piercing-rolling process by using a piercing mill that includes a pusher on the entrance side, a plug on the exit side along a pass line, and a plurality of angled rolls around the plug in a facing relation to each other, characterized in that:

in the case where the maximum diameter of an unsound region consisting of center segregation and porosity in the cross section of the billet is d [mm], piercing-rolling is performed under the condition that the plug nose rolling reduction ratio (TDF) expressed by Formula (1) satisfies Formula (2):

$$TDF=(\mathrm{Bd}-D1)/Bd \quad (1)$$

$$TDF\leq -0.50\times(d/\mathrm{Bd})+0.06 \quad (2)$$

where, in Formulae (1) and (2),

Bd: billet diameter [mm], and

D1: angled roll opening [mm] at plug nose position.

In the above-described method for producing a seamless tube/pipe, it is preferable that after the billet has been pushed by the pusher and has been engaged into the angled rolls, the pushing of the billet by means of the pusher be continued until the piercing-rolling reaches the steady state.

Also, in the above-described method for producing a seamless tube/pipe, it is preferable that the piercing-rolling be performed under the condition that the roll gorge draft (GDF) expressed by Formula (3) is in the range of 12% or more to 15% or less:

$$GDF=(\mathrm{Bd}-D2)/\mathrm{Bd}\times 100 \quad (3)$$

where, in Formula (3),

Bd: billet diameter [mm], and

D2: gorge portion roll opening [mm]

Further, in the above-described method for producing a seamless tube/pipe, it is preferable that a plug having the geometry that satisfies Formula (4) be used:

$$1.8\leq \mathrm{Pl}/\mathrm{Pd} \quad (4)$$

where, in Formula (4),

Pl: length [mm] from plug nose to maximum plug diameter position, and

Pd: maximum plug diameter [mm]

Advantageous Effect of Invention

The method for producing a seamless tube/pipe in accordance with the present invention achieves a remarkable effect that when piercing-rolling is performed, the occurrence of an inner surface flaw can be prevented reliably by considering the influence of the extent of occurrence of center segregation and porosity in a billet.

DESCRIPTION OF EMBODIMENT

An embodiment of the method for producing a seamless tube/pipe in accordance with the present invention will now be described in detail.

1. Piercing Machine

Figure 1:
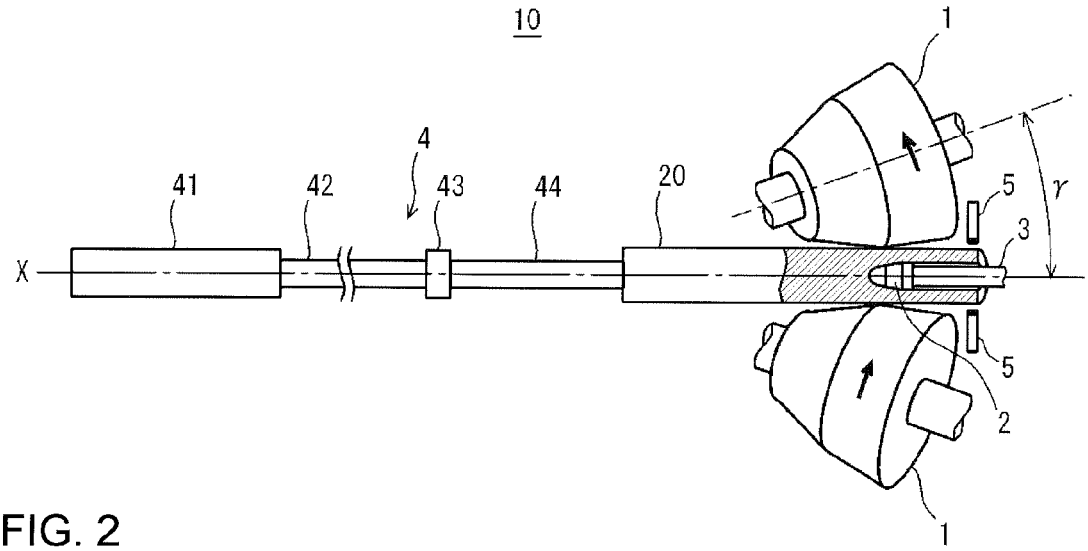
FIG. 1 is a top view schematically showing a configuration example of a piercing mill capable of being used in the method for producing a seamless tube/pipe in accordance with the present invention.
Figure 2:
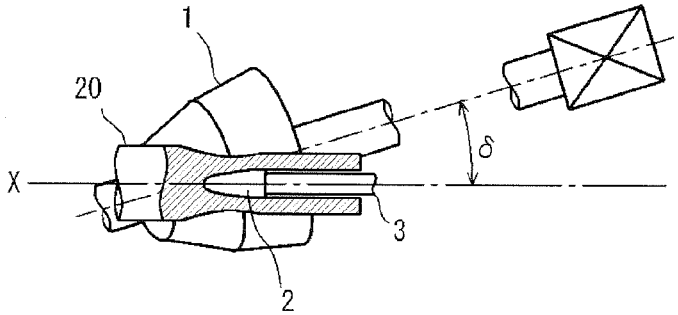
FIG. 2 is a side view schematically showing the vicinity of the piercing position of the piercing mill shown in FIG. 1.

FIG. 1 is a top view schematically showing a configuration example of a piercing mill capable of being used in the method for producing a seamless tube/pipe in accordance with the present invention, and FIG. 2 is a side view schematically showing the vicinity of the piercing position of the piercing mill. As shown in FIGS. 1 and 2, a piercing mill 10 includes a pair of angled rolls 1, a plug 2, a mandrel 3, a pusher 4, and an HMD (Hot Metal Detector) 5.

The paired angled rolls 1 are disposed so as to face to each other, as being around the circumference of the plug 2, in a state of having a predetermined crossing angle γ and inclination angle δ with respect to a pass line X. The angled roll 1 is not limited to a cone-type one as shown in FIGS. 1 and 2, and may be a barrel-type one. Also, the piercing mill 10 is not limited to a two-roll type one provided with two angled rolls 1 as shown in FIGS. 1 and 2, and may be a three-roll type one provided with three angled rolls.

The plug 2 is fitted into the front end portion of the mandrel 3 and is connected to the mandrel 3, and is arranged on the pass line X between the angled rolls 1 on the exit side of the piercing mill 10. As the plug 2, a plug having a speciality shape, described later, can be used.

The pusher 4 is disposed on the pass line X on the entrance side of the piercing mill 10. The pusher 4 shown in FIG. 1 is composed of a cylinder body 41, a cylinder rod 42, a connecting member 43, and a billet pushing rod 44. The billet pushing rod 44 is connected to the cylinder rod 42 by the connecting member 43 so as to be rotatable in a circumferential direction. As the cylinder body 41, a hydraulic one or a motor-driven one can be used, and the cylinder body 41 enables the cylinder rod 42 to advance or retreat.

The pusher 4 configured as described above pushes a billet 20 by abutting the front end of the billet pushing rod 44 against the rear end of the billet 20 supplied on the pass line X and by advancing the cylinder rod 42 and the billet pushing rod 44 by means of the cylinder body 41. Thereby, the billet 20 is conveyed toward the angled rolls 1 and the plug 2 along the pass line X, and is engaged with the angled rolls 1. Further, the pusher 4 continues to push the billet 20 during the time from when the billet 20 engaged with the angled rolls 1 comes into contact with the nose of the plug 2 to when the piercing-rolling reaches the steady state, that is, during the time of unsteady state.

The steady state means a state during the time period between when the front end of the piercing-rolled billet 20 (hollow material tube/pipe) leaves the angled rolls land when the rear end of the billet 20 leaves the angled rolls 1. The unsteady state means a state during the time period between when the front end of the billet 20 is engaged with the angled rolls 1 and when the steady state is started.

The HMD 5 is disposed near the rear end of the angled roll 1 on the exit side of the piercing mill 10. The HMD 5 detects whether or not the front end of the piercing-rolled hollow blank has passed through between the angled rolls 1, that is, the piercing-rolling has reached the steady state from the unsteady state.

2. Piercing-Rolling

The method for producing a seamless tube/pipe in accordance with the present invention is to piercing-roll a billet by using the above-described piercing mill. The details of this method are explained below.

2-1. Plug Nose Rolling Reduction Ratio (TDF)

Figure 3:
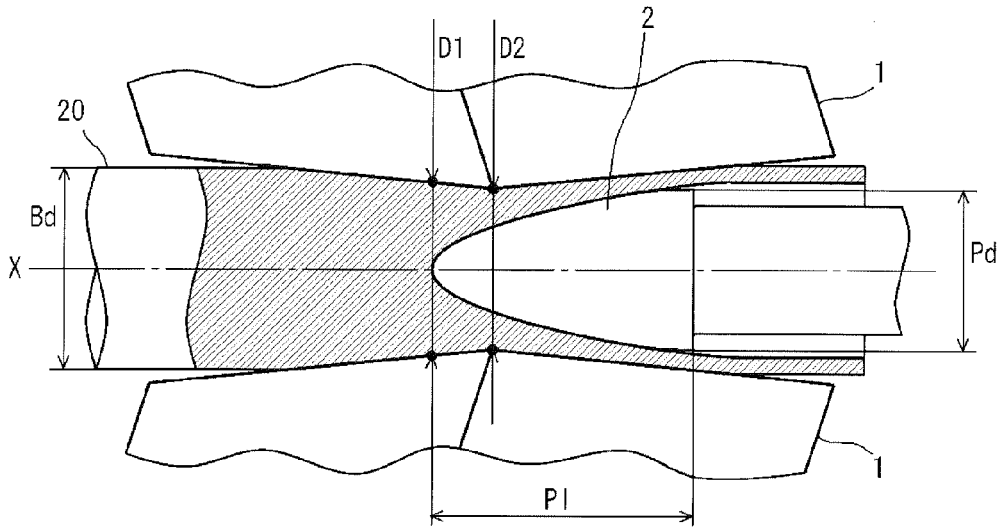
FIG. 3 is schematic views for depicting various dimensions employed in the method for producing a seamless tube/pipe in accordance with the present invention, FIG. 3(*a*) showing the relationship among angled rolls, a plug, and a billet at the time of piercing-rolling, and FIG. 3(*b*) showing an unsound region in the billet.
Figure 3:
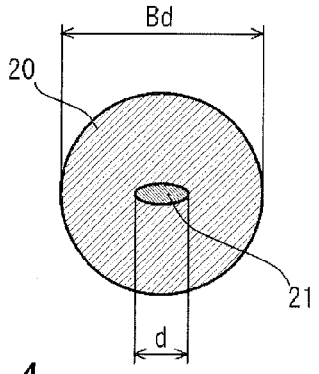

FIG. 3 is schematic views for depicting various dimensions employed in the method for producing a seamless tube/pipe in accordance with the present invention. FIG. 3(*a*) shows the relationship among angled rolls, a plug, and a billet at the time of piercing-rolling, and FIG. 3(*b*) shows an unsound region in the billet.

As being proved by examples, described later, it was found that the extent of occurrence of center segregation and porosity in the billet exerts a great influence on the occurrence of inner surface flaw, and based on the findings, the present invention was completed. That is, in the production method of the present invention, as the extent of occurrence of center segregation and porosity in the billet, attention is paid to an unsound region 21 consisting of center segregation and porosity in the cross section of the billet 20, and in the case where the maximum diameter of the unsound region 21 is d[mm], piercing-rolling is performed under the condition that the plug nose rolling reduction ratio (TDF) expressed by Formula (1) satisfies Formula (2):

$$TDF=(\mathrm{Bd}-D1)/\mathrm{Bd} \quad (1)$$

$$TDF\leq -0.50\times(d/\mathrm{Bd})+0.06 \quad (2)$$

where, in Formulae (1) and (2),

Bd: billet diameter [mm], and

D1: angled rolls opening [mm] at plug nose position (refer to FIG. 3(*a*)).

The reason why the plug nose rolling reduction ratio (TDF) is defined to satisfy Formula (2) as a function of a ratio "d/Bd" of the maximum diameter "d" of the unsound region 21 in the billet 20 to the billet diameter "Bd" as described above is as described below. Since the inner surface flaw formed by piercing-rolling is caused by the center segregation and porosity, the inner surface flaw is liable to occur with the increase in the proportion of the unsound region 21 (center segregation and porosity) to the cross section of billet, that is, the ratio "d/Bd". Therefore, in order to prevent the occurrence of inner surface flaw, even if the plug nose rolling reduction ratio is decreased, it is necessary to increase the lowering of the plug nose rolling reduction ratio as the ratio "d/Bd" comes to get larger. Between the plug nose rolling reduction ratio (TDF) and the ratio "d/Bd", there is a correlation such that the inner surface flaw does not occur if Formula (2) is satisfied. Therefore, by decreasing the plug nose rolling reduction ratio (TDF) so that the relationship expressed by Formula (2) as a function of a ratio "d/Bd" is satisfied, the occurrence of an inner surface flaw is prevented reliably when piercing-rolling is performed.

In order to lower the plug nose rolling reduction ratio (TDF), in the case where the billet diameter "Bd" is fixed, the opening "D1" between the angled rolls 1 at the plug nose position has only to be increased. The increase of the opening "D1" can be realized by use of angled rolls 1 that have been designed in advance so as to have such a dimension. Besides, it can be realized by widening the installation space between the angled rolls 1 or by arranging the plug 2 further on the entrance side of the pass line when piercing-rolling is performed.

Also, the maximum diameter "d" of the unsound region 21 in the billet 20 can be grasped by taking a cross section sample from the billet 20 and by examining the cross section of the sample.

2-2. Pushing of Billet by Pusher

In the case where the plug nose rolling reduction ratio is lowered so as to satisfy the relationship expressed by Formula (2) as described above, the roll opening at the plug nose position widens relatively with respect to the billet diameter. Accordingly, when piercing-rolling is performed, the engagement of the billet with the angled rolls becomes unsteady, and faulty roll engagement may occur. To prevent this faulty roll engagement, in the production method of the present invention, after the billet has been pushed by the pusher and has been engaged into the angled rolls, the pushing of the billet by means of the pusher is preferably continued until the piercing-rolling reaches the steady state.

The judgment as to whether or not the piercing-rolling has reached the steady state can be made by the detection result of the HMD 5 shown in FIG. 1. For example, based on the detection result of the HMD 5, when the front end of the hollow material tube/pipe passes between the angled rolls 1, it is judged that the piercing-rolling has reached the steady state from the unsteady state, and the pusher 4 stops pushing the billet 20.

2-3. Roll Gorge Draft (GDF)

In the production method of the present invention, it is preferable that the piercing-rolling be performed under the condition that the roll gorge draft (GDF) expressed by Formula (3) is in the range of 12% or more to 15% or less:

$$GDF=(Bd-D2)/Bd\times 100 \quad (3)$$

where, in Formula (3),

Bd: billet diameter [mm] of billet, and

D2: opening [mm] between gorge portions of angled rolls (refer to FIG. 3(*a*)).

The reason why the range of the roll gorge draft (GDF) is defined is as described below. In the case where the billet diameter "Bd" is fixed, the roll opening "D2" decreases with the increase in the roll gorge draft (GDF), so that, for the billet being piercing-rolled, the ovality of the cross section thereof increases, and the angle of engagement in the rotation direction with the angled rolls enlarges. This enlargement of engagement angle brings about a slippage of the billet. On the other hand, the roll opening "D2" increases with the decrease in the roll gorge draft (GDF), so that the contact area between the angled rolls and the billet decreases, and in this case as well, a slippage occurs. Therefore, the roll gorge draft must be set in a proper range to prevent the slippage from occurring, and for this purpose, the roll gorge draft has only to be set in the range of 12% or more to 15% or less.

2-4. Plug geometry

In the production method of the present invention, a plug having the geometry that satisfies Formula (4) is preferably used:

$$1.8\leq Pl/Pd \quad (4)$$

where, in Formula (4),

Pl length [mm] from plug nose to maximum plug diameter position, Pd: maximum plug diameter [mm].

In the case where the plug nose rolling reduction ratio is decreased so as to satisfy the relationship expressed by Formula (2) as described above, when piercing-rolling is performed, a faulty roll engagement may occur. Although this faulty roll engagement can be prevented by the continuation of pushing of the billet by means of the pusher, the faulty roll engagement can also be prevented by making the plug geometry proper. That is, as shown in FIG. 3(*a*), in the case where the length from the plug nose to the maximum plug diameter position is taken as "Pl" (hereinafter, referred also to as a "plug rolling portion length"), and the maximum plug diameter is taken as "Pd", as being proved by examples, described later, by increasing the ratio "Pl/Pd" of the plug rolling portion length "Pl" to the maximum plug diameter "Pd" so that Formula (4) is satisfied, the contact length between the plug and the billet is increased, and thereby the faulty roll engagement can be prevented.

EXAMPLES

Example 1

[Test Method]

Tests were conducted in which billets made of carbon steel and 13% Cr steel were piercing-rolled by using the piercing mill shown in FIG. 1. In the tests, as billets made of each steel type, billets were employed while varying the ratio "d/Bd" of the maximum diameter "d" of the unsound region to the billet diameter "Bd" in the range of 0.05 to 0.15. Also, piercing-rolling was performed by changing the plug nose rolling reduction ratio (TDF) in the range of 0 to 0.03. Other test conditions were as follows.

Billet dimensions: diameter 187 mm, length 1750 mm

Billet heating temperature: 1230° C.

Crossing angle of angled roll 10.0°, inclination angle thereof 11.0°

Roll gorge draft (GDF): 13.3%

Plug geometry: "Pl (plug rolling portion length)/Pd (maximum plug diameter)" 2

Pushing of billet by means of pusher: continued until piercing-rolling reaches steady state Hollow shell dimensions: outside diameter 196 mm, wall thickness 16.87 mm, length 4970 mm

[Evaluation Method]

Figure 4:
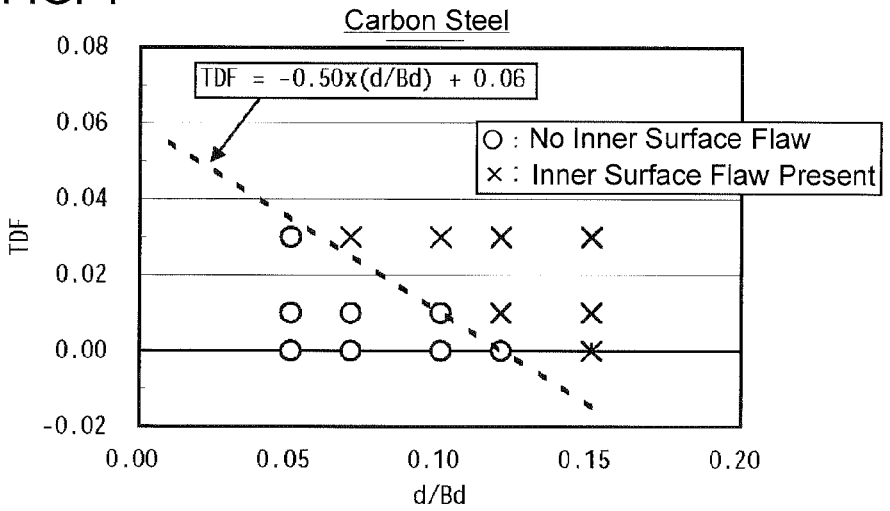
FIG. 4 is a diagram showing, in correlation between d/Bd and TDF, a state in which an inner surface crack is generated in piercing-rolling for carbon steel.
Figure 5:
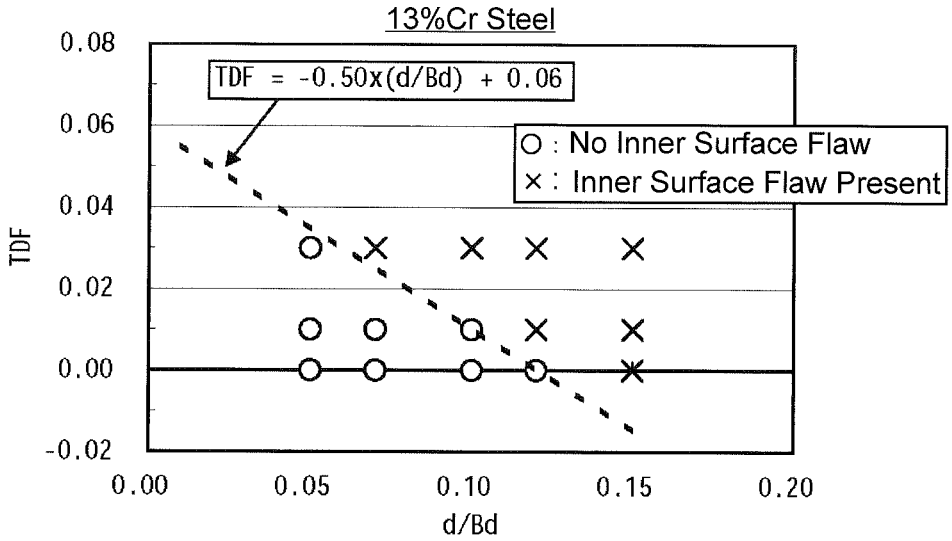
FIG. 5 is a diagram showing, in correlation between d/Bd and TDF, a state in which an inner surface crack is generated in piercing-rolling for 13% Cr steel.

After the piercing-rolling, the inner surface of hollow shell was observed, and the state of occurrence of inner surface flaw was examined. The examination results are given in Table 1, and FIGS. 4 and 5 summarize the results given in Table 1.

TABLE 1

| Steel type | d/Bd | TDF: (Bd − D1)/Bd | Quality evaluation |
|---|---|---|---|
| Carbon steel | 0.05 | 0.03 | ○ |
| | 0.05 | 0.01 | ○ |
| | 0.05 | 0 | ○ |
| | 0.07 | 0.03 | x |
| | 0.07 | 0.01 | ○ |
| | 0.07 | 0 | ○ |
| | 0.10 | 0.03 | x |
| | 0.10 | 0.01 | ○ |
| | 0.10 | 0 | ○ |
| | 0.12 | 0.03 | x |
| | 0.12 | 0.01 | x |
| | 0.12 | 0 | ○ |
| | 0.15 | 0.03 | x |
| | 0.15 | 0.01 | x |
| | 0.15 | 0 | x |
| 13% Cr steel | 0.05 | 0.03 | ○ |
| | 0.05 | 0.01 | ○ |
| | 0.05 | 0 | ○ |
| | 0.07 | 0.03 | x |
| | 0.07 | 0.01 | ○ |
| | 0.07 | 0 | ○ |
| | 0.10 | 0.03 | x |
| | 0.10 | 0.01 | ○ |
| | 0.10 | 0 | ○ |
| | 0.12 | 0.03 | x |
| | 0.12 | 0.01 | x |
| | 0.12 | 0 | ○ |
| | 0.15 | 0.03 | x |
| | 0.15 | 0.01 | x |
| | 0.15 | 0 | x |

In Table 1, symbols in the column of "Quality evaluation" mean as follows:

○: Good. Indicating that no inner surface flaw was found.

x: Poor. Indicating that inner surface flaw was found.

FIG. 4 is a diagram showing, in correlation between d/Bd and TDF, a state in which an inner surface crack is generated in piercing-rolling for carbon steel. FIG. 5 is a diagram showing, in correlation between d/Bd and TDF, a state in which an inner surface crack is generated in piercing-rolling for 13% Cr steel.

[Test Result]

From the results shown in Table 1 and FIGS. 4 and 5, the followings are seen.

For either of carbon steel and 13% Cr steel, the plug nose rolling reduction ratio (TDF) in which an inner surface flaw occurs decreases with the increase in the ratio "d/Bd" of the maximum diameter "d" of the unsound region in the billet to the billet diameter "Bd". The boundary between the presence and absence of inner surface flaw can be expressed by a formula of "TDF=−0.50×(d/Bd)+0.06". From this fact, it was revealed that by decreasing the plug nose rolling reduction ratio (TDF) so as to satisfy the relationship expressed by Formula (2) of (TDF≤−0.50×(d/Bd)+0.06) as a function of the ratio "d/Bd", the occurrence of inner surface flaw can be prevented reliably when piercing-rolling is performed.

Example 2

[Test Method]

As in the above-described Example 1, tests were conducted in which billets made of carbon steel and 13% Cr steel were piercing-rolled by using the piercing mill shown in FIG. 1. In the tests, plugs having geometry factors "P1 (plug rolling portion length)/Pd (maximum plug diameter)" of 1.8 and 2 were employed, and further, for comparison, a plug having a geometry factor "Pl/Pd" of 1.6 was employed. For any of the plugs, piercing-rolling was performed by changing the plug nose rolling reduction ratio (TDF) in the range of 0 to 0.03 that satisfies the relationship expressed by Formula (2). Other test conditions were the same as those in Example 1.

[Evaluation Method]

In Example 2, when piercing-rolling was performed, the engagement performance of the billet with the angled rolls was examined. The engagement performance of the billet was evaluated by the presence or absence of faulty engagement. Table 2 gives the examination results.

TABLE 2

| Steel type | Pl/Pd | TDF: (Bd − D1)/Bd | Engagement performance evaluation |
|---|---|---|---|
| Carbon steel | 1.60 | 0.03 | ○ |
| | 1.60 | 0.01 | x |
| | 1.60 | 0 | x |
| | 1.80 | 0.03 | ○ |
| | 1.80 | 0.01 | ○ |
| | 1.80 | 0 | ○ |
| | 2.00 | 0.03 | ○ |
| | 2.00 | 0.01 | ○ |
| | 2.00 | 0 | ○ |
| 13% Cr steel | 1.60 | 0.03 | x |
| | 1.60 | 0.01 | x |
| | 1.60 | 0 | x |
| | 1.80 | 0.03 | ○ |
| | 1.80 | 0.01 | ○ |
| | 1.80 | 0 | ○ |
| | 2.00 | 0.03 | ○ |
| | 2.00 | 0.01 | ○ |
| | 2.00 | 0 | ○ |

In Table 2, symbols in the column of "Engagement performance evaluation" mean as follows:

○: Good. Indicating that no occurrence of faulty engagement was found.

x: Poor. Indicating that occurrence of faulty engagement was found.

[Test Result]

From the results shown in Table 2, the followings are seen.

It was revealed that, for either of carbon steel and 13% Cr steel, even in the case where piercing-rolling is performed under the condition that the plug nose rolling reduction ratio (TDF) satisfies the relationship expressed by Formula (2), by using a plug having the geometry in which "Pl/Pd" satisfies Formula (4) of (1.8 Pl/Pd), faulty engagement can be prevented.

INDUSTRIAL APPLICABILITY

The present invention can be used effectively for the production of a seamless tube/pipe using the Mannesmann tube-making process, and is useful for piercing-rolling in the case where seamless tubes/pipes made of any steel types are produced.

REFERENCE SIGNS LIST

1: angled roll, 2: plug, 3: mandrel, 4: pusher, 5: HMD (Hot Metal Detector), 10: piercing mill, 20: billet, 21: unsound region, 41: cylinder body, 42: cylinder rod, 43: connecting member, 44: billet pushing rod, X: pass line

What is claimed is:

1. A method for producing a seamless tube/pipe by using a piercing mill including a pusher on the entrance side, a plug on the exit side along a pass line, and a plurality of angled rolls as being provided around the plug, the method comprising the steps of:

supplying a billet on the pass line, the billet including an unsound region consisting of center segregation and porosity in a cross section of the billet;

pushing the billet to convey the billet toward the angled rolls; and piercing-rolling the billet by the piercing mill so that a plug nose rolling ratio (TDF) expressed by Formula (1) satisfies Formula (2):

$$TDF=(\mathrm{Bd}-D1)/\mathrm{Bd} \quad (1)$$

$$TDF\leq -0.50\times(d/\mathrm{Bd})+0.06 \quad (2)$$

where, in Formulae (1) and (2),

Bd: billet diameter [mm],

D1: opening [mm] between angled rolls at plug nose position, and d: maximum diameter [mm] of the unsound region in the cross section of the billet.

2. The method for producing a seamless tube/pipe according to claim 1, wherein in the step of pushing the billet, after the billet has been pushed by the pusher and has been engaged into the angled rolls, the pushing of the billet by the pusher is continued until the piercing-rolling reaches a steady state.

3. The method for producing a seamless tube/pipe according to claim 2, further comprising performing the piercing-rolling under a condition that a roll gorge draft (GDF) expressed by Formula (3) is in a range of 12% or more to 15% or less:

$$\mathrm{GDF}=(\mathrm{Bd}-D2)/\mathrm{Bd}\times 100 \quad (3)$$

where, in Formula (3),

Bd: billet diameter [mm], and

D2: opening [mm] between gorge portions of angled rolls.

4. The method for producing a seamless tube/pipe according to claim 3, further comprising using the plug having a geometry that satisfies Formula (4):

$$1.8\leq \mathrm{Pl/Pd} \quad (4)$$

where, in Formula (4),

Pl: length [mm] from plug nose to plug maximum diameter position, and

Pd: maximum plug diameter [mm].

5. The method for producing a seamless tube/pipe according to claim 2, further comprising using the plug having a geometry that satisfies Formula (4):

$$1.8 \leq Pl/Pd \quad (4)$$

where, in Formula (4),

Pl: length [mm] from plug nose to plug maximum diameter position, and

Pd: maximum plug diameter [mm].

6. The method for producing a seamless tube/pipe according to claim 1, further comprising performing the piercing-rolling under a condition that a roll gorge draft (GDF) expressed by Formula (3) is in a range of 12% or more to 15% or less:

$$GDF=(Bd-D2)/Bd\times 100 \ldots \quad (3)$$

where, in Formula (3),

Bd: billet diameter [mm], and

D2: opening [mm] between gorge portions of angled rolls.

7. The method for producing a seamless tube/pipe according to claim 6, further comprising using the plug having a geometry that satisfies Formula (4):

$$1.8 \leq Pl/Pd \quad (4)$$

where, in Formula (4),

Pl: length [mm] from plug nose to plug maximum diameter position, and

Pd: maximum plug diameter [mm].

8. The method for producing a seamless tube/pipe according to claim 1, further comprising using the plug having a geometry that satisfies Formula (4):

$$1.8 \leq Pl/Pd \quad (4)$$

where, in Formula (4),

Pl: length [mm] from plug nose to plug maximum diameter position, and

Pd: maximum plug diameter [mm].

* * * * *